US012336616B1

(12) United States Patent
Yan

(10) Patent No.: US 12,336,616 B1
(45) Date of Patent: Jun. 24, 2025

(54) CONTAINER FOR A STICK PRODUCT

(71) Applicant: ID PACKAGING Inc., Kirkland (CA)

(72) Inventor: Jian Yan, Kirkland (CA)

( * ) Notice: Subject to any disclaimer, the term of this patent is extended or adjusted under 35 U.S.C. 154(b) by 0 days.

(21) Appl. No.: 18/990,501

(22) Filed: Dec. 20, 2024

(51) Int. Cl.
*A45D 40/06* (2006.01)
*A45D 40/00* (2006.01)

(52) U.S. Cl.
CPC ..... *A45D 40/06* (2013.01); *A45D 40/065* (2013.01); *A45D 2040/0031* (2013.01); *A45D 2040/0043* (2013.01)

(58) Field of Classification Search
CPC ..... A45D 40/06; A45D 40/065; A45D 40/02; A45D 40/023; A45D 40/04; A45D 2040/0043; A45D 2040/0037
See application file for complete search history.

(56) References Cited

U.S. PATENT DOCUMENTS 5,988,917 A 11/1999 Sheffler et al.
8,132,977 B2 3/2012 Pires et al.
9,113,693 B2 8/2015 Yan
9,723,907 B2 * 8/2017 Huang ..... A45D 40/14
10,881,184 B1 1/2021 Yan
11,311,092 B1 4/2022 Yan
11,684,138 B1 6/2023 Yan et al.

FOREIGN PATENT DOCUMENTS

TW 202143886 A * 12/2021 ..... A45D 40/00

* cited by examiner

*Primary Examiner* — Jennifer C Chiang
(74) *Attorney, Agent, or Firm* — Anglehart et al.

(57) ABSTRACT

A disposable cartridge assembly for stick products, intended to be used in conjunction with a rotating base that unlocks the cartridge and raises and lowers the stick product freely, while a holding cup slides in a six-track spiral sleeve of the disposable cartridge. The disposable cartridge has a decorative shell fastened onto the spiral sleeve via an interference fit, for omitting any chemical adhesive. The rotating base is intended to remain connected to the cartridge assembly for the life of the stick product, but may be detached and reused with multiple cartridges, which can be sold individually for the purpose. These designs provide advantages of lower damage rate of transport, better product performance, higher cost efficiency and eco-friend manufacturing and using.

18 Claims, 15 Drawing Sheets

CONTAINER FOR A STICK PRODUCT

TECHNICAL FIELD

The present invention relates to a container for housing a stick product, especially lipstick. More particularly, it relates to a locking mechanism of a disposable cartridge of the stick product that allows a movable holding cup being locked in its retracted position so that the stick product is protected before the installation of the disposable cartridge.

BACKGROUND ART

Prior art containers for stick products may include a cylinder that has a rotatable member disposed at its bottom end. The stick product is received into a holding cup, and the holding cup is disposed within the cylinder. Rotation of the rotatable member relative to the cylinder causes a mechanism inside the cylinder to advance the expendable mass longitudinally away from the rotatable member such that a portion of the stick product becomes exposed above the cylinder. In this manner, the exposed portion of the stick product is available for application.

Disposable cartridges for stick products are considered environmentally friendly in a way that lesser material is utilized in their manufacturing. For example, there are available stick product packages which are refillable where a disposable cartridge is replaced once the stick is used up by the user. These reusable shell parts are economical for the consumers as well as manufacturers, especially these reusable shell parts are well designed with unique appearance and expensive materials. The consumers don't have to spend the same amount of money for the refills while for manufacturers they enable lower consumption of inputs such as raw materials and energy.

One known refillable stick product is disclosed in U.S. Pat. No. 8,132,977, disclosing: a refill container comprising: at least two receptacles, the receptacles are fixedly attached to each other by an attachment means, and the at least two receptacles are configured to be securely placed in a refillable case; said case comprises a base and a cover, and at least one of the receptacles is configured to be securely received in the base of the refillable case such that the product stored in said receptacle is not accessible after assembling the said receptacle and the base. The base of the refillable case and the at least one receptacle of the refill container to be received by said base have a locking arrangement to securely keep the refill container in place, and the base of the refillable case and the receptacle of the refill container will either be transparent or have a transparent window to show the color of the product stored within the receptacle of the refill container. Such transparent parts presenting a visual indication of the color of the new replacement improve the user's experience.

Another known refillable stick product is disclosed in U.S. Pat. No. 10,881,184, disclosing: a disposable cartridge housing a stick product, has a locking feature that prevents a holding cup from moving within an inner body, to protect the stick product during transport. The locking feature comprises protrusions on the holding cup, the protrusions extend outward and rest in the slots on the inner body, which forms a locked configuration; when the disposable cartridge is installed onto a reusable base, a circular unlocking tool applies pressure to the outward extended protrusions, causing the protrusions deflected inward to an unlocked position.

The locking features in U.S. Pat. No. 8,132,977 secure the stick product after installing in the reusable case, but the cup holding the lipstick could move upward accidentally, then causing damage of the product, for example during transport.

The locking features in U.S. Pat. No. 10,881,184 secure the stick product before installing in the reusable case, preventing the above accident, however, when the holding cup moves up from its locked position, the holding cup moves away from the disclosed unlocking tool, thus the protrusions are released to the outward position, causing friction between the protrusions and the wall of the inner body.

Another known stick product is disclosed in U.S. Pat. No. 11,311,092, disclosing: the decorative shell is fastened onto the spiral sleeve with one or more flexible tabs in-between, which provide pressure between the contacted surfaces, so as to omit the usage of glue. Although the glue-free concept is advantageous, the fastening structure in U.S. Pat. No. 11,311,092 is complicate and difficult to assemble.

Therefore, it is desirable to provide better structures such as a new locking mechanism and better glue-free setting for the disposable refill cartridge of the stick product for protecting the stick product before installation, during transport.

SUMMARY OF INVENTION

According to an embodiment of the invention, a disposable cartridge for refilling in a reusable shell comprises, a holding cup, being configured for receiving and retaining a stick product, the holding cup has at least one lug located on the outer surface of the holding cup and an aperture on its outer surface; a cylindrical inner body, having top and bottom openings, and a cylindrical side wall with at least one longitudinal slot, the cylindrical inner body has at least one flexible tab located on its lower portion, a tip portion of the flexible tab extending inward and inserted into the aperture of the holding cup, so as to lock the holding cup with the inner body in a locked position; and a cylindrical spiral sleeve, having top and bottom openings, and a cylindrical side wall with at least one spiral track located on the interior surface. The holding cup, the inner body, and the spiral sleeve are assembled in order from inside to outside in a coaxial manner, the at least one lug may be slidable in the at least one longitudinal slot and in the spiral track, so that the inner body is configured to be rotated and drive the lug to slide along the spiral track, so as to drive the holding cup to move in the axial direction.

The reusable shell comprises a reusable rotating base and a cover. The disposable cartridge is configured to be installed into the reusable rotating base, a middle portion of the flexible tab is configured to contact an unlock structure on the reusable rotating base, enabling the tip portion of the flexible tab to move outward and release the holding cup from its locked position.

According to another embodiment of the invention, a disposable cartridge of a stick product comprises a holding cup, a cylindrical inner body and a cylindrical spiral sleeve, wherein the cylindrical spiral sleeve has 6 spiral tracks evenly spread on its inner surface, enabling the cylindrical spiral sleeve being adaptively suitable for the holding cup with 180-degree spread two lugs or 120-degree spread three lugs.

According to another embodiment of the invention, a disposable cartridge of a stick product comprises a holding cup, a cylindrical inner body, a cylindrical spiral sleeve and a cylindrical shell, wherein the cylindrical spiral sleeve has at least one embossed portion on the outer surface, and the shell has at least one concaved portion on its inner surface at the respective position for the embossed portion of the cylindrical spiral sleeve; wherein an interference fit between the concaved portion and the embossed portion fastens the shell on the cylindrical spiral sleeve.

According to another embodiment of the invention, a stick product, comprising: a cylindrical body, having one of an embossed portion and a concaved portion on the outer surface; and a cylindrical shell, having another one of an embossed portion and a concaved portion on the inner surface, at the respective position for the one of an embossed portion and a concaved portion of the cylindrical body, wherein the cylindrical body is inserted into the cylindrical shell by aligning the concaved portion with the embossed portion to form an interference fit, so as to fasten the cylindrical body and the shell.

According to another embodiment of the invention, a disposable cartridge of a stick product is provided, the disposable cartridge comprises a cylindrical spiral sleeve and a shell; at least one embossed portion being formed on the outer surface of the cylindrical spiral sleeve; at least one concaved portion at the respective position for the embossed portion being set on the inner surface of the shell; and the diameter of the embossed portion may be slightly bigger than the diameter of the inner surface of the concaved portion, so as to fasten the cylindrical spiral sleeve and the shell.

BRIEF DESCRIPTION OF DRAWINGS

So that the manner in which the above-recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIG. 8 is an elevation view showing the assembled three elements of the holding cup, the inner body and the cylindrical spiral sleeve, with a stick product in.

DETAILED DESCRIPTION

Figure 1:
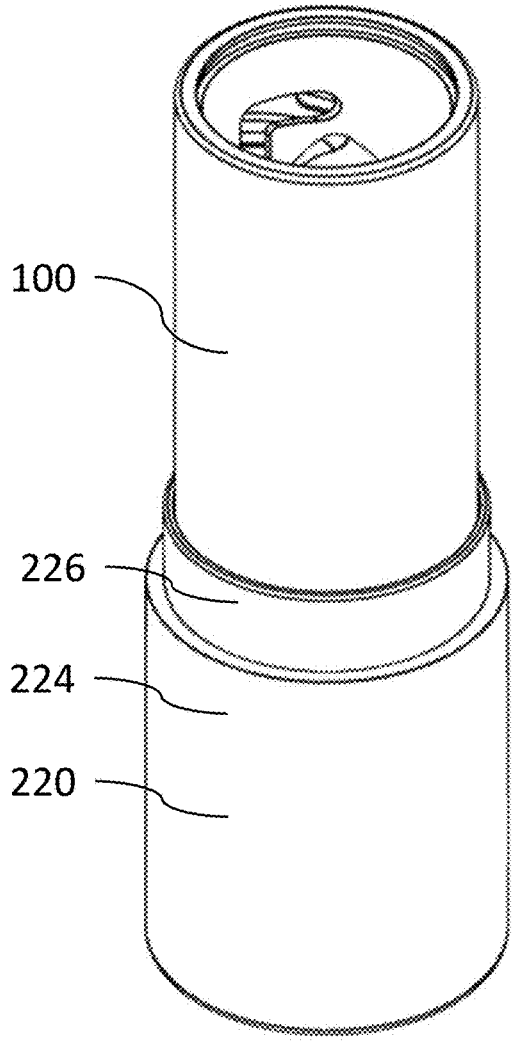
FIG. 1 depicts an assembled disposable cartridge and rotating base, according to the present invention, with a stick product in the cartridge.
Figure 2:
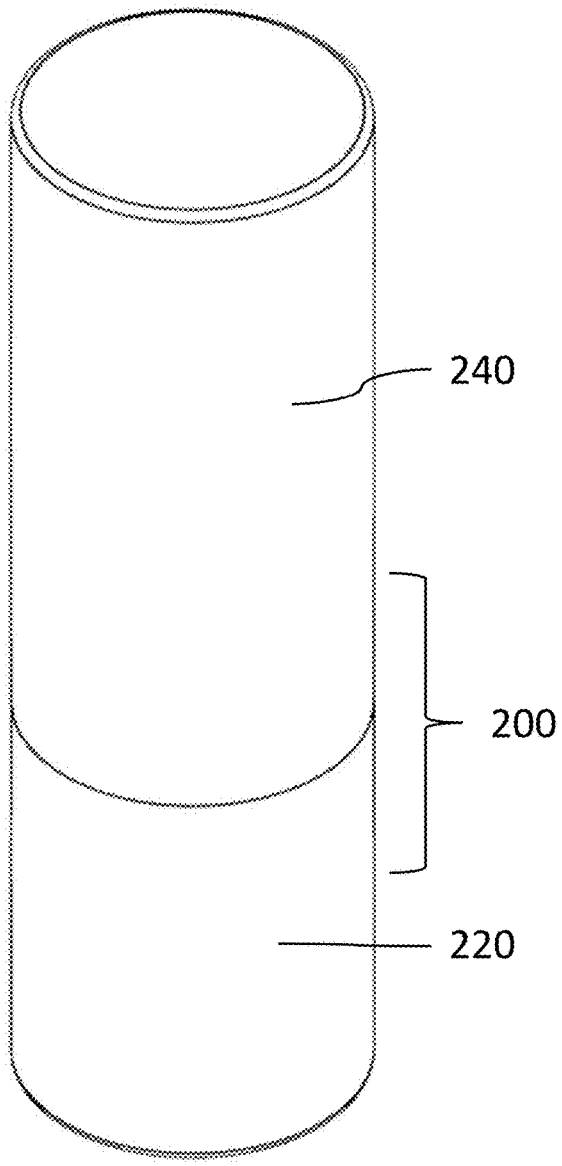
FIG. 2 depicts the assembled stick product with a cover on the disposable cartridge and rotating base of FIG. 1.
Figure 3:
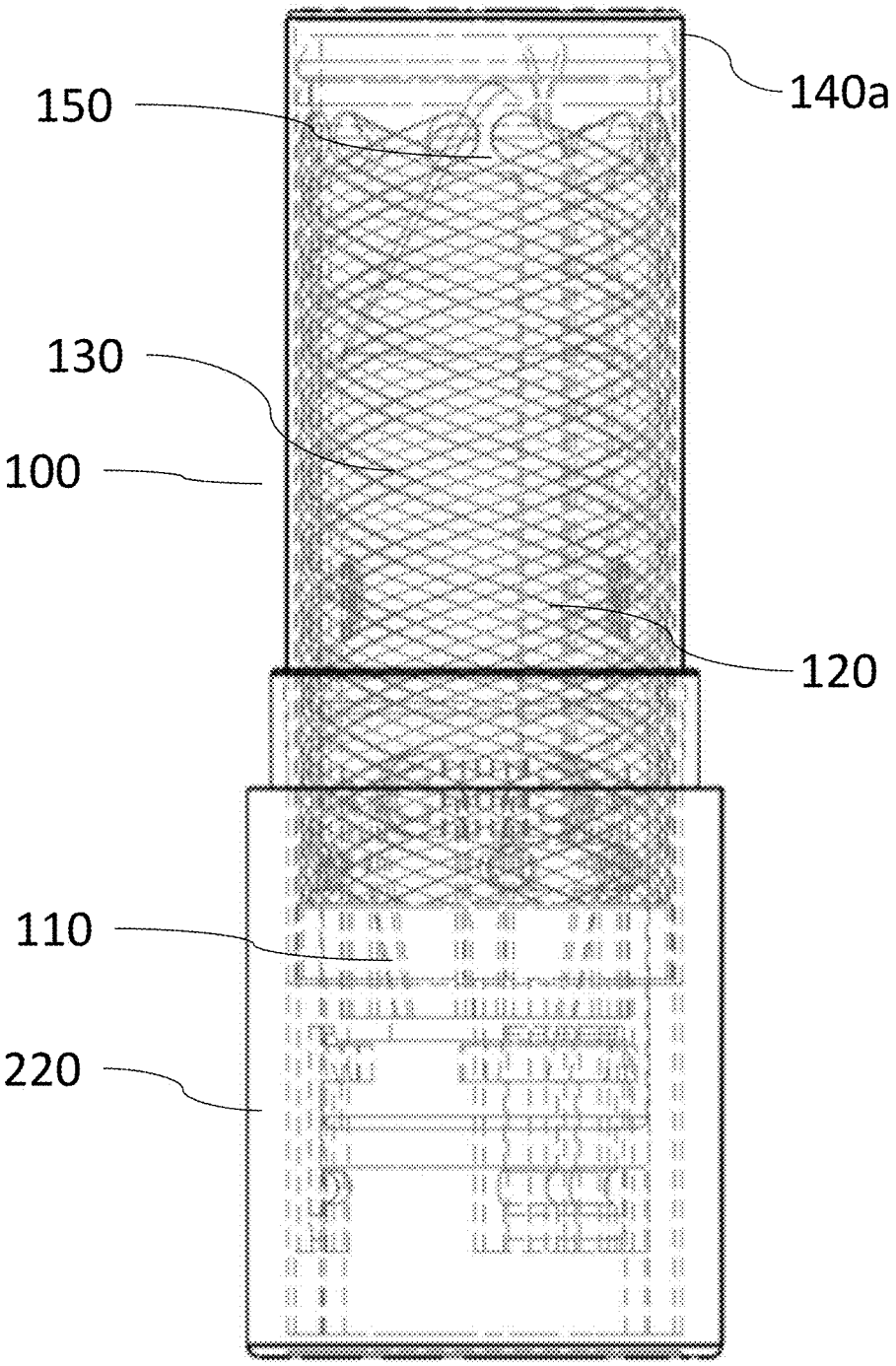
FIG. 3 is an elevation view showing the disposable cartridge and rotating base of FIG. 1.

Referring to FIGS. 1-3, a container for a stick product according to the present invention comprises a disposable cartridge 100, a rotating base 220 and a top cover 240.

The top cover 240 comprises an opened bottom that is designed to cooperate with the base 220, and a closed top. The cover 240 protects the stick product of the container from the ambient environment, and may be removably secured to the rotating base 220 by some means, such as an interference fit or snap fit.

The Disposable Cartridge 100

Referring to FIGS. 3, 5-7, the disposable cartridge comprises at least an inner body 120, a holding cup 110 that is able to hold a stick product 150, and a spiral sleeve 130. In FIG. 3, there is a shell 140*a* secured to the outer surface of the spiral sleeve 130.

The Holding Cup 110

Figure 7:
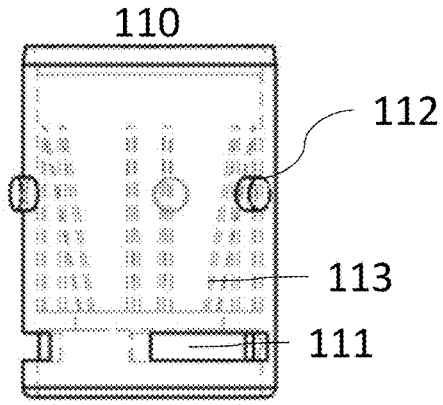
FIG. 7 is an elevation view showing an embodiment of a holding cup of the disposable cartridge of FIG. 3.

As shown in FIGS. 3 and 7, the holding cup 110 comprises a bottom that may be opened or closed, and an opened top. The top and bottom are separated by a side wall. The holding cup is able to receive and retain a stick product 150 which may be inserted into the holding cup through the opened top. Another known method to add the stick product 150 into the holding cup or into the assembled cartridge 100 is back filling the liquefied stick balm from the bottom hole of the holding cup into a mold, then removing the mold from the opened top of the holding cup.

The holding cup 110 has at least one lug 112, preferably two or three lugs located on the outer surface, as in FIG. 7, there are three lugs located 120 degrees apart; the two-lug setting will be 180 degrees apart.

The holding cup 110 has at least one aperture 111 located on the lower portion of the side wall, and the aperture 111 is configured to receive at least one locking tip located on the inner surface of the inner body 120, so that the holding cup 110 with the supported stick product 150 may be secured inside the inner body 120 before the installation of the disposable cartridge 100. The aperture 111 can be a circular groove on the outer surface, or at least one penetrating opening, preferably two or three openings evenly apart, as shown in FIG. 7, three openings 111.

Optionally, several ribs 113 for holding the stick product 150 are located evenly in the lower part of the inner surface of the holding cup 110.

The Inner Body 120

Figure 5:
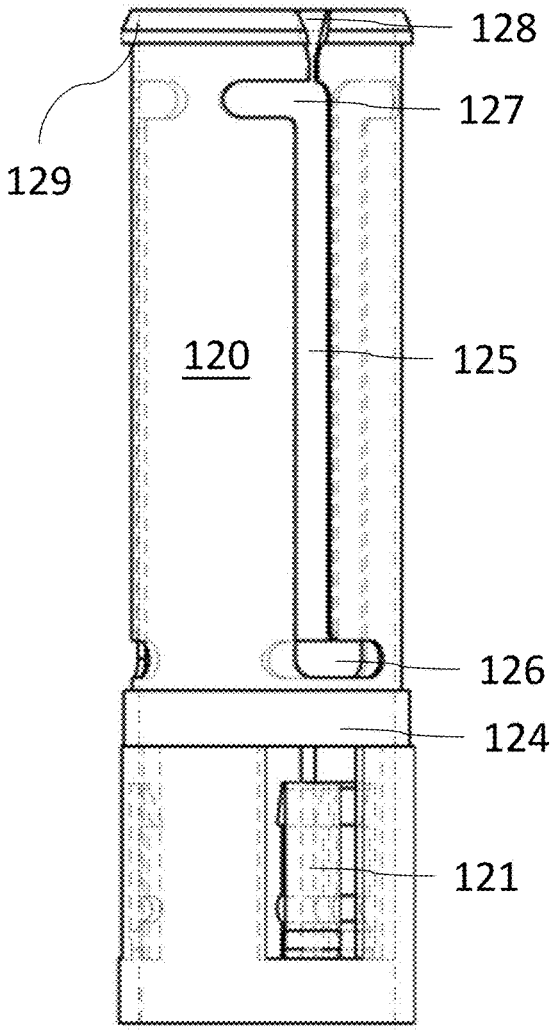
FIG. 5 is an elevation view showing an embodiment of an inner body of the disposable cartridge of FIG. 3.

Referring to FIGS. 3 and 5, the inner body 120 is a generally cylindrical member that has an opened top and an opened bottom separated by a side wall.

At least one longitudinal slot 125, pass through the side wall, preferably two or three slots 125 are set, three shown in FIG. 5. Each longitudinal slot extends between an upper horizontal track 127 at its upper end, and a lower horizontal track 126 at its lower end. At least one upper horizontal track intersects with a notch 128 that opens up onto the top of the inner body 120. In FIGS. 5 and 21-23, only one of the upper horizontal tracks intersects with a notch 128. Alternatively, two or three horizontal tracks intersect with a notch that opens up onto the top of the inner body 120. In either embodiment, the side wall of the inner body 120 has some flexibility, such that the opening at the top of the inner body can be temporarily enlarged or narrowed, and then allowed to return to its original size.

Preferably, the top of the inner body 120 may be formed with a rim 129 that overhangs the side wall; and below each lower horizontal track 126. at least one protrusion 124 on the outer surface of the inner body 120 extends outward.

The Spiral Sleeve 130

Figure 6:
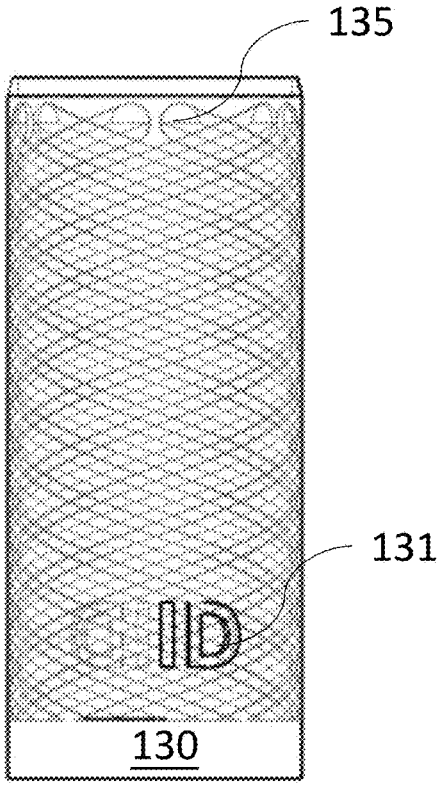
FIG. 6 is an elevation view showing an embodiment of a cylindrical spiral sleeve of the disposable cartridge of FIG. 3.

A spiral sleeve 130 is shown in FIG. 6. The spiral sleeve comprises a generally cylindrical body that has an opened top and an opened bottom separated by a side wall. The side wall may be generally solid. The interior surface of the side wall is provided with at least one spiral track 135. Each track starts at the top of the spiral sleeve and completes approximately one revolution to end above the bottom of the spiral sleeve. Corresponding to the number of the lugs on the holding cup 110 and the slots on the inner body 120, the respective numbers of lugs 112, slots 125 and tracks 135 could be a group of 1-1-1, 1-1-2, 1-1-3, 1-2-1, 1-2-6, 1-2-2, 1-2-3, 2-2-2, 2-2-4, 2-2-6, 3-3-3, or 3-3-6, thus six evenly apart tracks 135 on the inner surface of the spiral sleeve 130 is preferable, it provides advantages of light-weight product, easy adaptive assembly and high cost efficiency.

The starting points of the six essentially identical spiral tracks 135 are spaced 60 degrees apart, and likewise, the ending points. The spiral sleeve 130 fits over the inner body 120 in such a way that the lugs 112 of the holding cup 110 are located in and travel in the spiral tracks when assembled.

Assembly of the Disposable Cartridge 100

Figure 21:
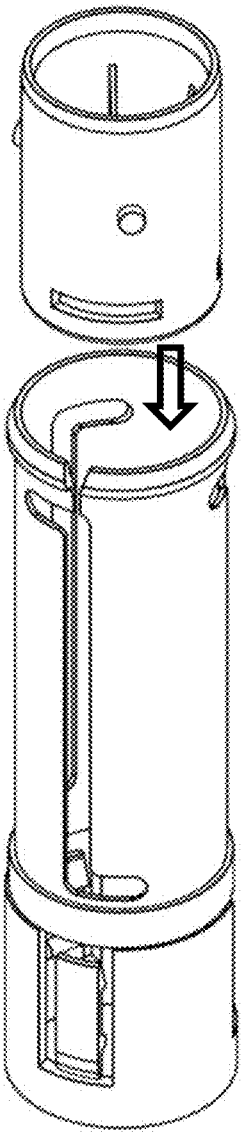
FIG. 21 is a perspective view of a holding cup, being installing into an inner body from the top opening of the inner body.

Referring to FIG. 21, the holding cup 110 fits inside the inner body 120, and can be inserted into the inner body through the top opening thereof. Regardless of whether the inner body has one, two or three notches, as described above, the flexibility of the side wall of the inner body allows the opening at the top to be enlarged an amount sufficient to allow one or more lugs to be inserted into one of the upper horizontal tracks 127. When the holding cup 110 is inserted, the lugs will be able to travel along the longitudinal slots 125 and horizontal track 127 of the inner body, preferably the lugs may slidably stay in the upper tracks 127 or in the upper portion of the slots 125. The lugs 112 are long enough to extend through and beyond the longitudinal slots and horizontal tracks of the inner body 120.

Figure 22:
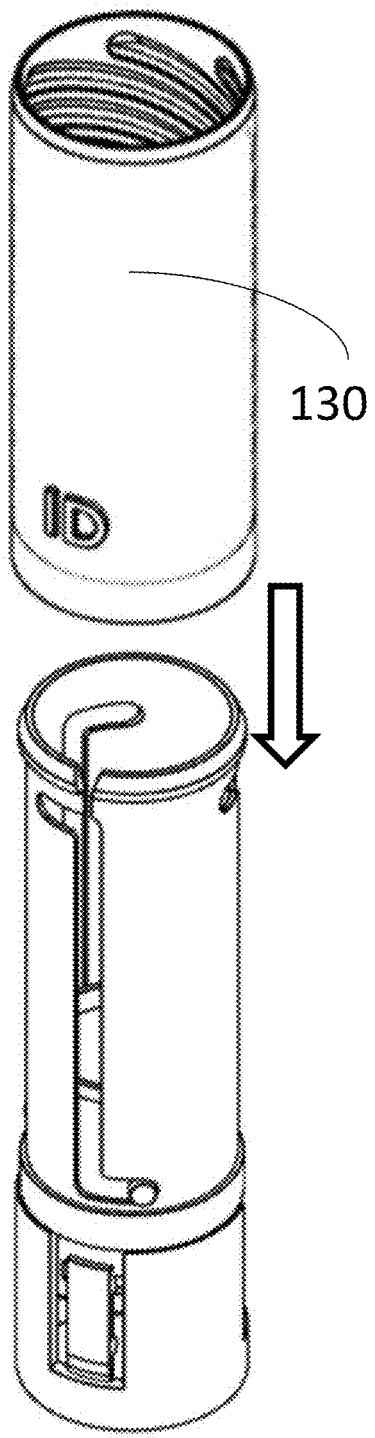
FIG. 22 is a perspective view of the inner body with a holding cup assembled of FIG. 21, being installed into a cylindrical spiral sleeve from the bottom opening of the cylindrical spiral sleeve.
Figure 23:
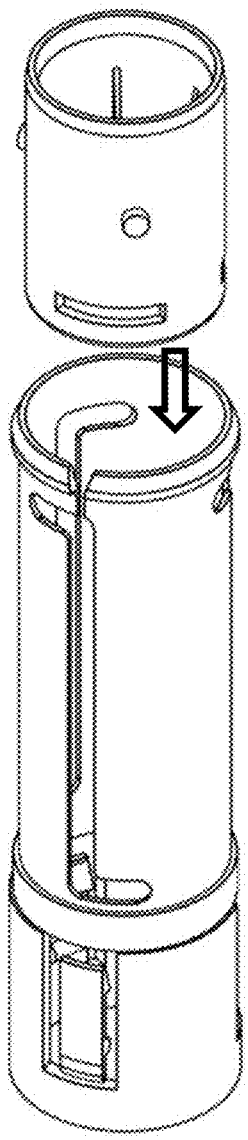
FIG. 23 is a perspective view of a holding cup, being installing into an inner body from the top opening of the inner body, exactly same as FIG. 21.

Referring to FIG. 22, the spiral sleeve 130 is designed slide over the inner body 120 in a concentric fashion. More specifically, the spiral sleeve may be mounted to the outside of the inner body by inserting the top part of the inner body 120 into the opened bottom of the spiral sleeve by pinching the top part of the inner body 120; thanks to the notch 128, the pinching enables the rim 129 and the top part of the inner body 120 being narrowed; meanwhile the tips of the lugs of the holding cup 110 extending out of the inner body fit into the bottom part of the spiral tracks 135. When fully seated on the inner body, the spiral sleeve and inner body are concentric, and the spiral sleeve may be trapped between the protrusions 124 of the inner body, and the rim 129 of the inner body. The spiral sleeve will substantially fill that space, so that very little vertical movement of the spiral sleeve with respect to the inner body is possible, however, the spiral sleeve and inner body can rotate with respect to one another. By design, the spiral sleeve extends over and hides the horizontal slots 125 of the inner body.

Figure 8:
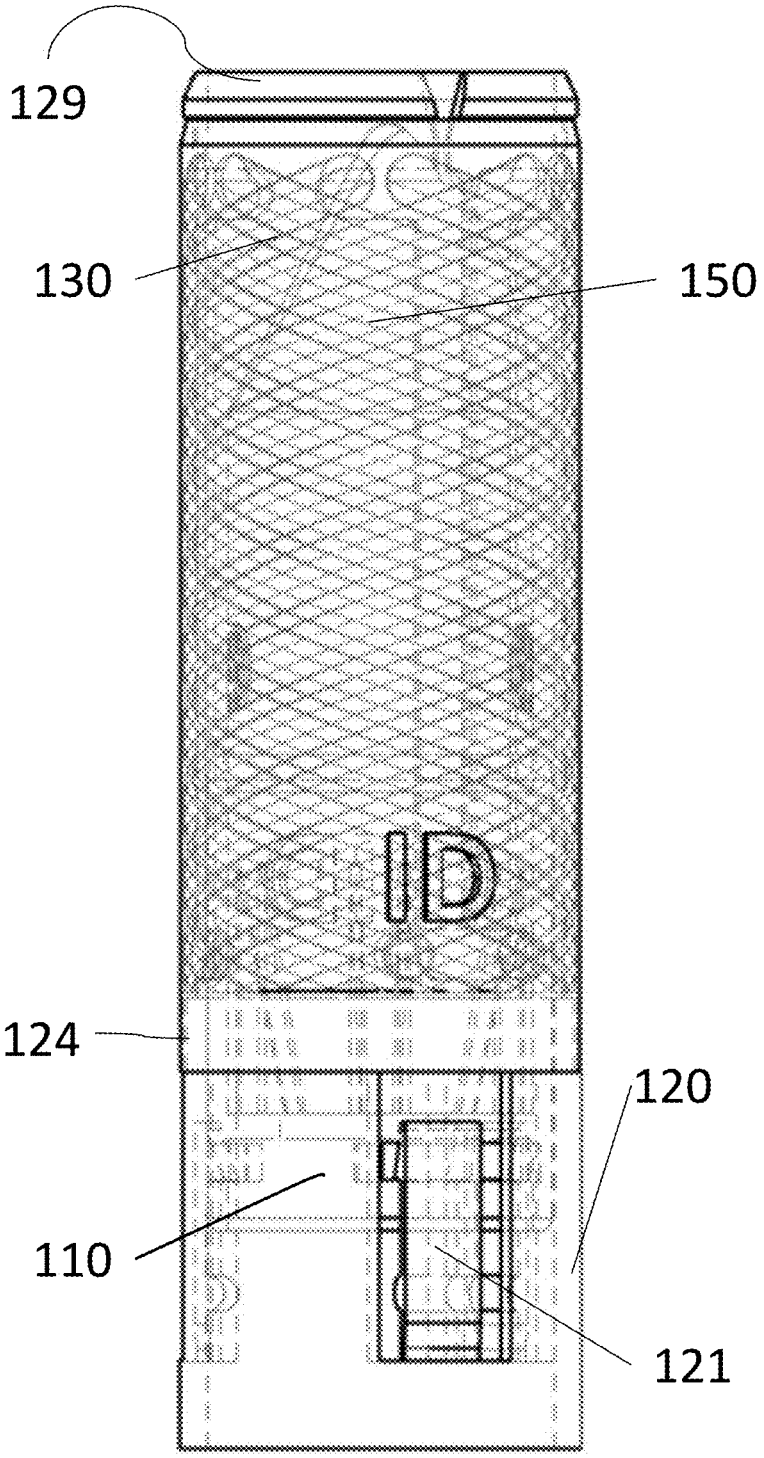
Figure 13:
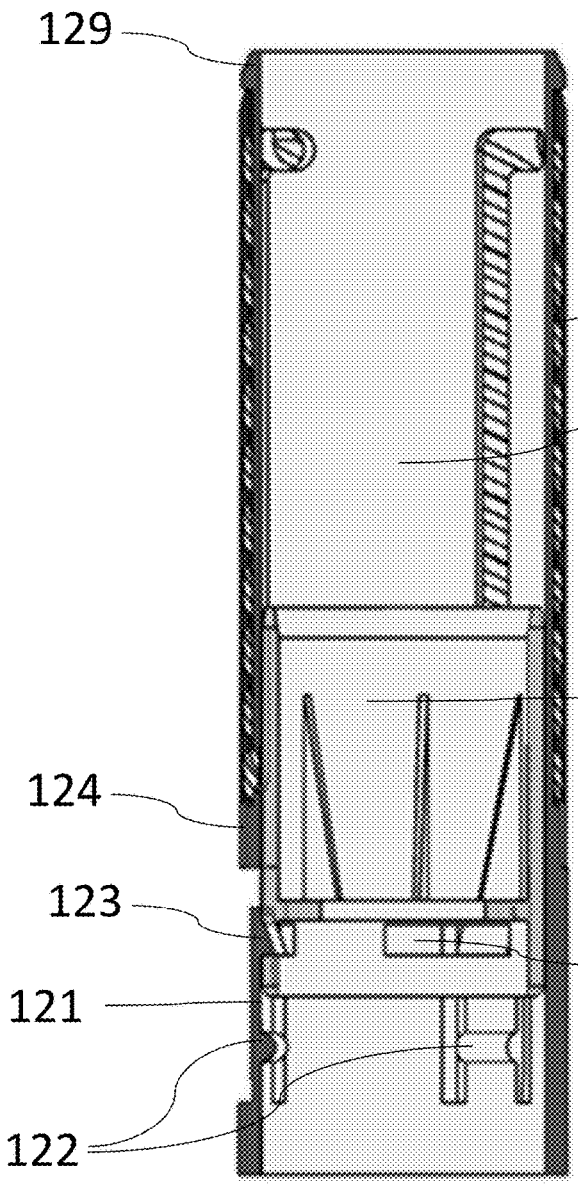
FIG. 13 is a side section view showing another alternate embodiment of the disposable cartridge, before installing on the rotating base.

Now referring to FIGS. 8 and 13, with the spiral sleeve 130 sliding down (with or without rotational motions) to its final low position, the holding cup 110 can slide down to its locked position, and the lugs 112 are in the horizontal tracks 126 (shown in FIG. 8, not shown in sectional FIG. 13). At least one flexible tab 121 may be located in the lower part of the side wall of the inner body 120, and a locking tip 123 on the flexible tab 121 extends inward into the aperture 111 of the holding cup 110, so as to lock the holding cup 110, then secure and protect the stick product inside the inner body 120.

According to an embodiment of the invention, preferably as shown in FIGS. 8 and 13, the flexible tab 121 may be hinged at its lower end to the side wall of the inner body 120, having a middle portion 122 and a top tip 123 both extending inward, such that the top tip 123 being inserted into a locking aperture of the holding cup 110, and the middle portion 122 contacting with an unlocking portion on the rotating base 220 for releasing the locked cup 110.

Figure 28:
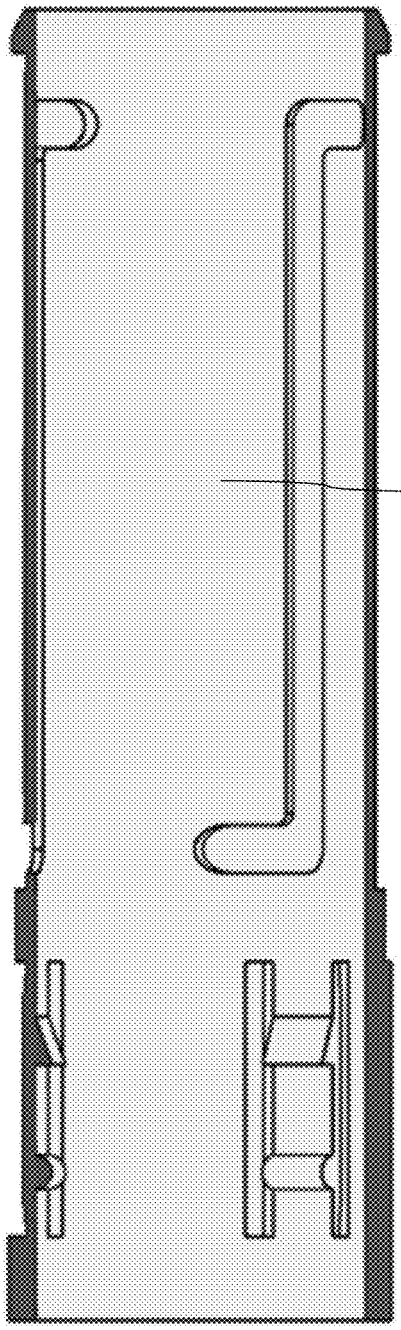
FIG. 28 is a side section view showing another embodiment of the inner body, with a different locking tab.
Figure 29:
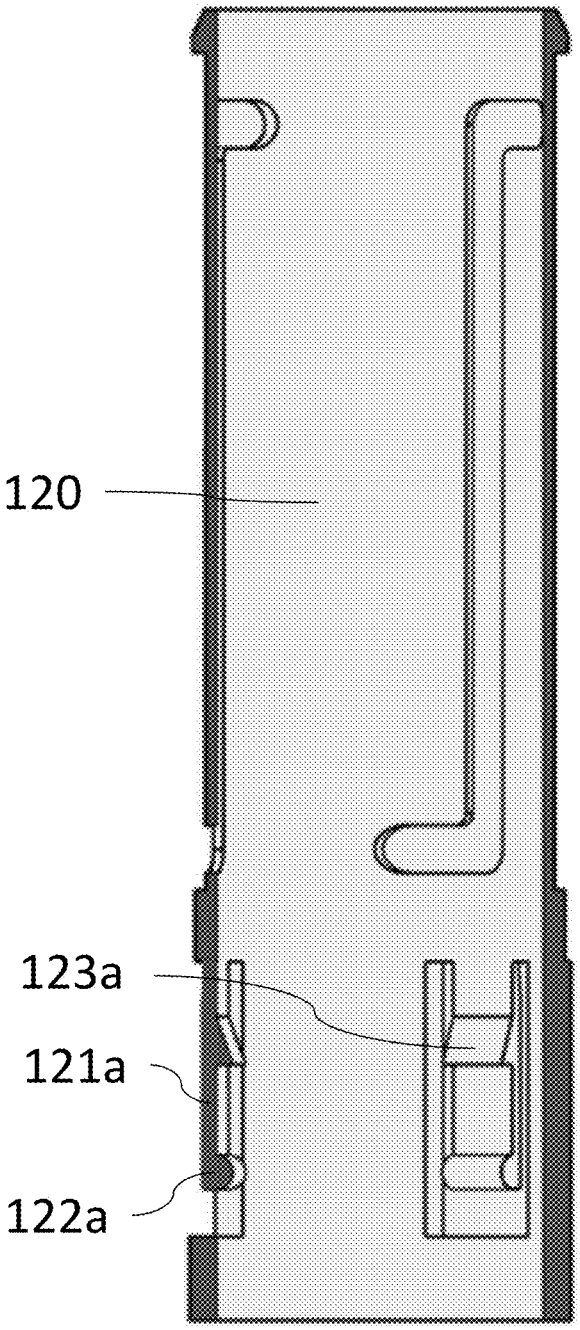
FIG. 29 is a side section view showing another embodiment of the inner body, with a different locking tab.

According to another embodiment of the invention, the locking structure may vary: as shown in FIG. 28, the flexible tab may be hinged to the side wall on its both up and low ends; in FIG. 29, the flexible tab 121*a* may be hinged at its upper end to the side wall of the inner body 120, having a lower portion 122*a* and a middle tip 123*a* both extending inward, such that the middle tip 123*a* being inserted into a locking aperture of the holding cup 110, and the lower portion 122*a* contacting with an unlocking portion on the rotating base 220 for releasing the locked cup 110.

The assembled inner body 120, holding cup 110 with the stick product 150 and spiral sleeve 130 constitute the disposable cartridge 100, as shown in FIG. 8, and FIG. 13.

The Reusable Rotating Base 220

Figure 4:
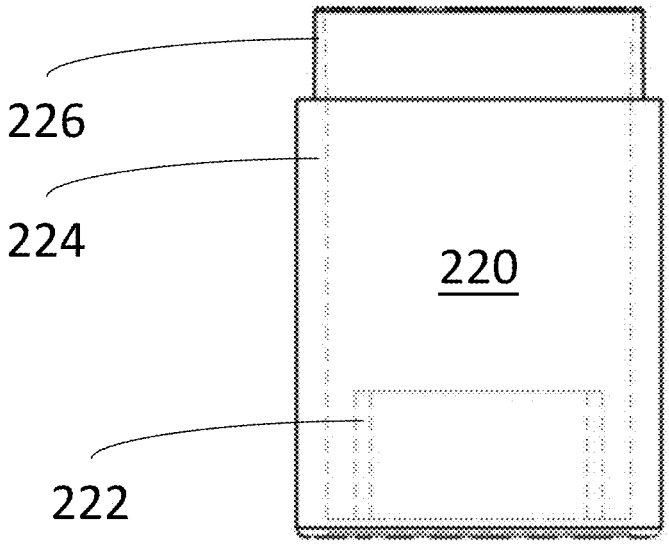
FIG. 4 is an elevation view showing the rotating base of FIG. 1.

Referring to FIG. 4 and FIG. 3, one embodiment of a reusable rotating base 220 is shown. An outer ring 224 and an inner ring 222 are concentric, and rise from a bottom surface. Both rings are open at the top. The rotating base 220 is designed to fit onto the bottom of the disposable cartridge 100 in a removable fashion.

Around the upper end of the outer ring 224, an outer shoulder 226 may be formed to receive the circular edge of the top cover 240, by some removable means, such as an interference fit or snap fit.

The bottom of the inner body 120 is able to slide in and out of the inner surface of the outer ring 224 of the rotating base 220. Also, the contacted surface between the inner surface of the outer ring 224 and the low outer surface of the inner body 120 features such engaging means that rotation of the base 220 with respect to the spiral sleeve 130 will result in rotation of the inner body with respect to the spiral sleeve 130. Engaging means are well known, such as vertical grooves on both contacted surfaces, which is a common design and not illustrated here.

Installing the Cartridge 100 on the Rotating Base 220

Figure 14:
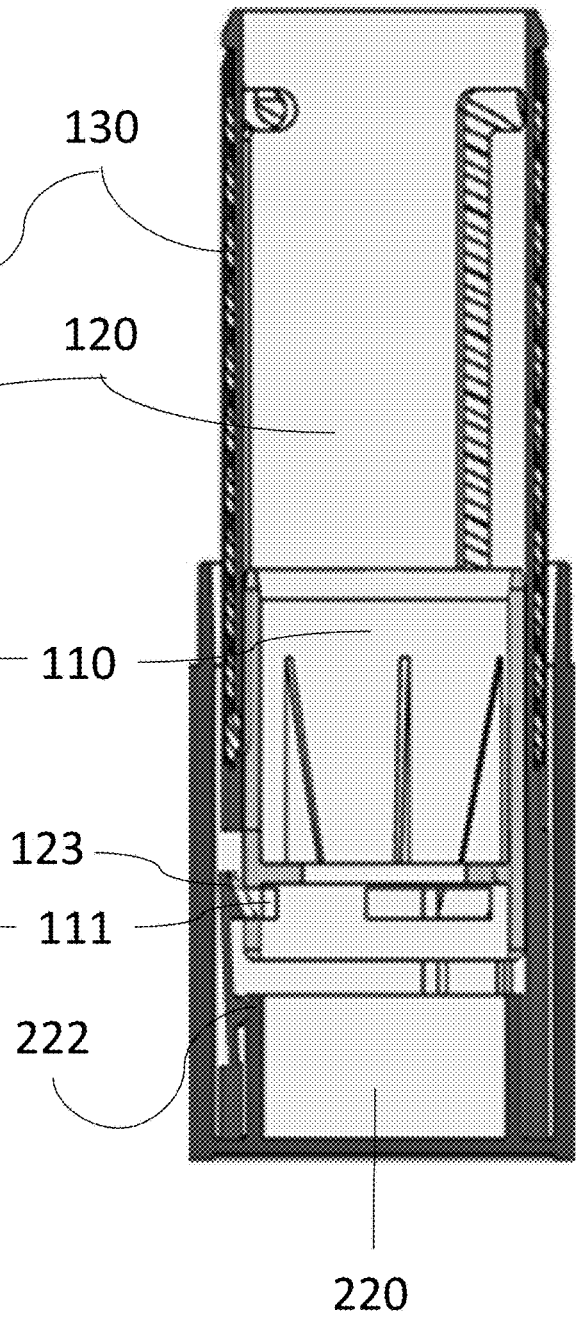
FIG. 14 is a side section view showing the disposable cartridge of FIG. 13, installed on the rotating base.

Referring to FIG. 13, the disposable cartridge 100 is assembled (the stick product 150 is omitted in the figure for better viewing); then referring to FIG. 14, the disposable cartridge 100 may be installed to a reusable rotating base 220.

As will now be described, the locking tip 123 of the inner body 120 will be extended outward from in the aperture 111 of the holding cup 110 by sliding the rotating base 220 on to the bottom of the disposable cartridge 100. The top edge of the inner ring 222 is configured to contact the flexible tab 121 of the inner body 120 so as to pivot the flexible tab 121, thus pushing the locking tip 123 outward and out of the aperture 111 of the holding cup 110, as releasing the holding cup 110 from its locked position.

More specifically, a diameter of a middle portion 122 of the flexible tab 121 may be a little smaller than the outer diameter of the inner ring 222; and the middle portion 122 contacts the circular top edge of the inner ring 222 while the low part of the inner body 120 slides between the inner ring 222 and the outer ring 224 of the base 220.

After installing the disposable cartridge 100 on the rotating base 220, as shown in FIG. 14, the holding cup 110 is released from it locked position, and the inner body 120 may be fastened to the rotating base 220. As described above, the spiral sleeve 130 and the inner body 120 can rotate with respect to one another, namely the inner body 120 and the rotating base 220 as a whole piece element can rotate with respect to the spiral sleeve 130, therefore the lugs 112 of the holding cup 110 will interact with the horizontal slots 125 and the spiral tracks 135.

More specifically, the horizontal slots 125 will push the lugs sideways in order to drive the lugs along the tracks 135, by this action, the holding cup 110 is raised and lowered. The rotating base 220 may remain connected to the disposable cartridge for the life of the stick product, or may be easily detached, especially for reuse with a different disposable cartridge. The rotating base may be detached from the disposable cartridge, by simply sliding the rotating base off of the disposable cartridge.

Details for the Six Spiral Tracks 135

As described above, the number of the lugs on the holding cup 110 can vary according to different embodiments, based on different considerations, such as the performance of the product, the cost of materials and the complexity of the manufacturing.

The popular choice of the lugs currently is two located on the opposite spots of the outer surface of the holding cup, as two lugs and two horizontal slots, as well as two spiral tracks.

Three lugs paired with 3 horizontal slots and 3 spiral tracks provide improved stability of the holding cup in the inner body, therefore reducing the chance of accidental damage of the stick product.

With the design of six spiral tracks on the inner surface of the spiral sleeve, it reduces the amount of the material as well as makes the whole product lighter.

Furthermore, during manufacturing, a worker for a manual assembly or an automated machine needs to align the two lugs into the respective two spiral tracks, so the worker or the automated machine maybe needs to rotate one of the spiral sleeves and the assembled holding cup and inner body, about 180 degrees (rotating about 120 degrees for three lugs and three spiral tracks scenario). When the spiral sleeve has six spiral tracks, it is adaptive for both two and three lugs situations, it provides better efficiency of the scale production, meanwhile the worker or the automated machine will align the lugs with the spiral tracks with less degree rotation, as saving producing time.

Details for the Snap Fastening Between the Spiral Sleeve 130 and the Shell (140*a* 140*b* 140*c*)

Figure 17:
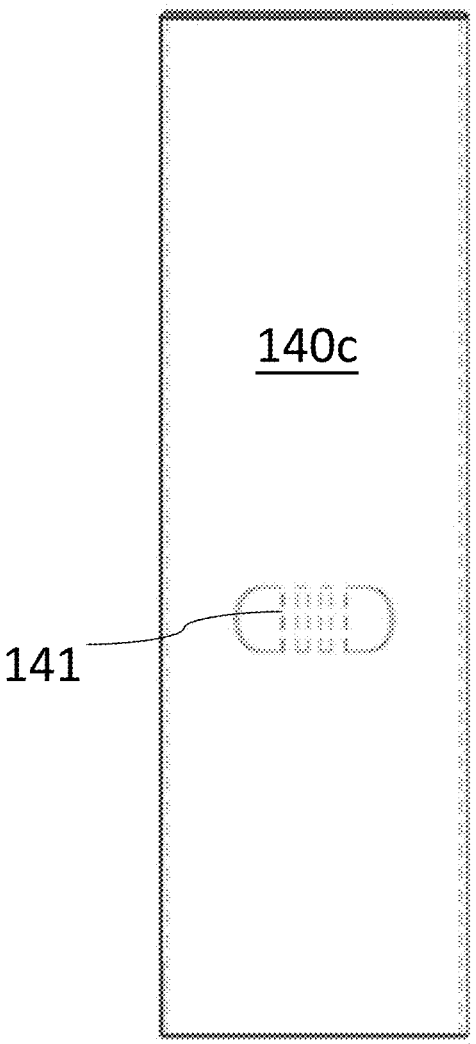
FIG. 17 is an elevation view showing another embodiment of a shell.
Figure 18:
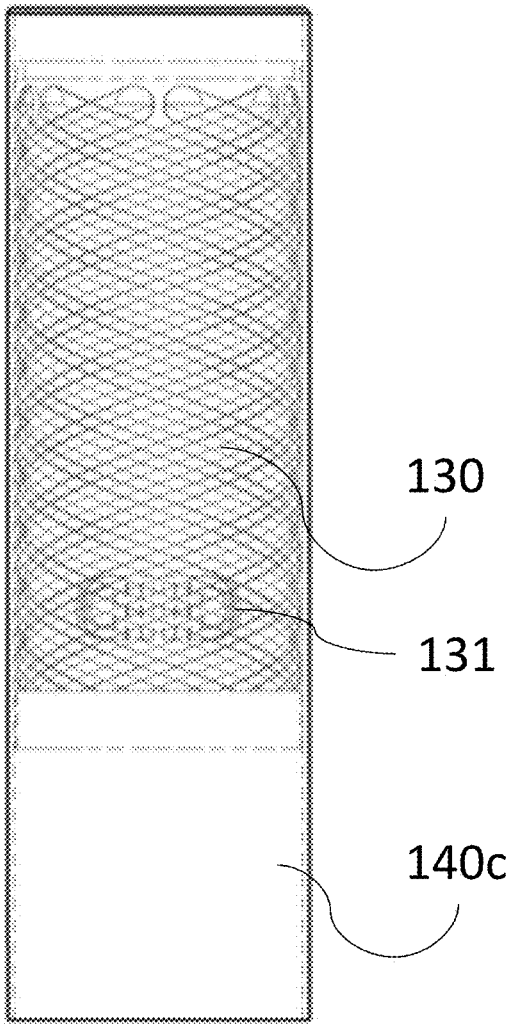
FIG. 18 is an elevation view showing the shell of FIG. 17, fastened onto the cylindrical spiral sleeve.
Figure 19:
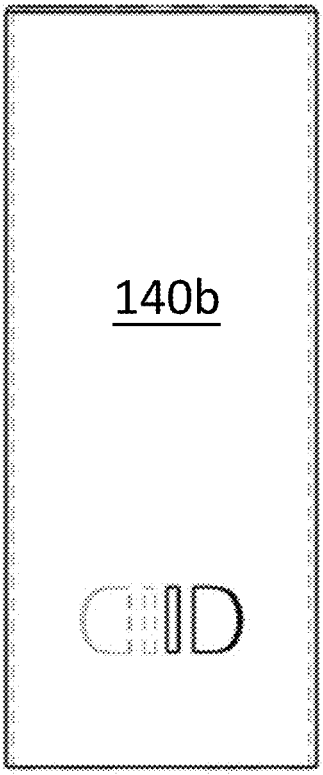
FIG. 19 is an elevation view showing another embodiment of a shell.
Figure 20:
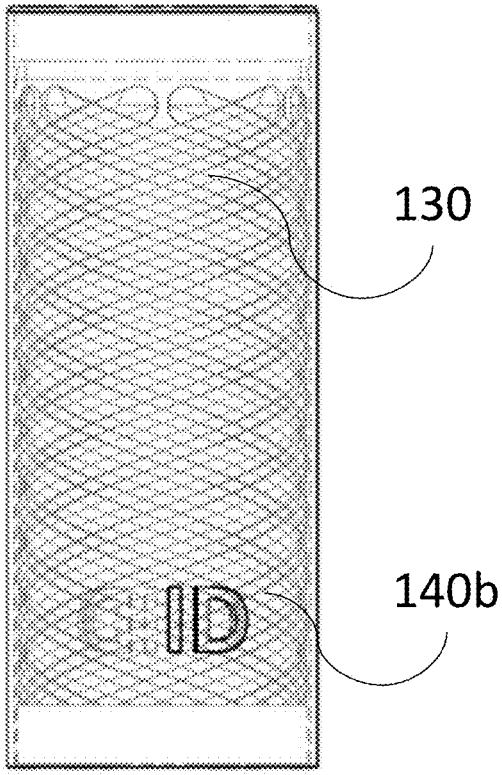
FIG. 20 is an elevation view showing the shell of FIG. 19, fastened onto the cylindrical spiral sleeve.

Referring to FIGS. 6, 17 and 18, the disposable cartridge comprises a cylindrical spiral sleeve 130 and a shell 140*c*; at least one embossed portion 131 being formed on the outer surface of the cylindrical spiral sleeve; at least one concaved portion 141 at the respective position for the embossed portion being set on the inner surface of the shell; and the diameter of the embossed portion may be slightly bigger than the diameter of the inner surface of the concaved portion, so as to fasten the cylindrical spiral sleeve and the shell.

Such an interference fit or snap fit between the cylindrical spiral sleeve and the shell omits the usage of glue or adhesive, which is not environmentally friendly; also the usage of glue requires extra steps of the glue application, therefore such a glue-free snap fit is cost-effective.

As shown in FIGS. 17 and 18, two embossed portions 131 may be evenly spaced on the outer surface of the cylindrical spiral sleeve; correspondingly two concaved portions 141 may be evenly spaced on the inner surface of the shell.

According to another embodiment of the invention, at least one recessed portion may be formed on the outer surface of the cylindrical spiral sleeve; at least one projecting portion at the respective position for the recessed portion may be set on the inner surface of the shell. While sliding the shell onto the cylindrical spiral sleeve, the at least one projecting portion fits into the at least one recessed portion, so as to fasten together and move (mostly rotate) as a whole piece.

Figure 15:
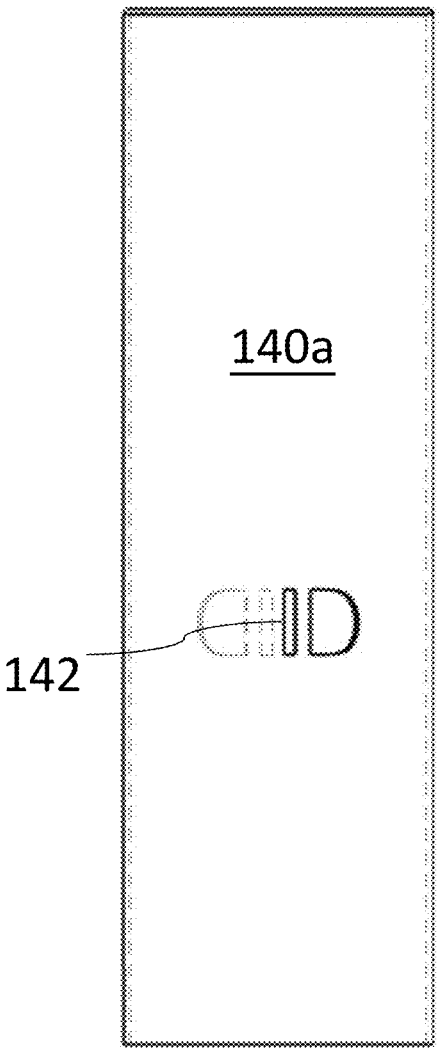
FIG. 15 is an elevation view showing an embodiment of a shell of the disposable cartridge of FIG. 3.
Figure 16:
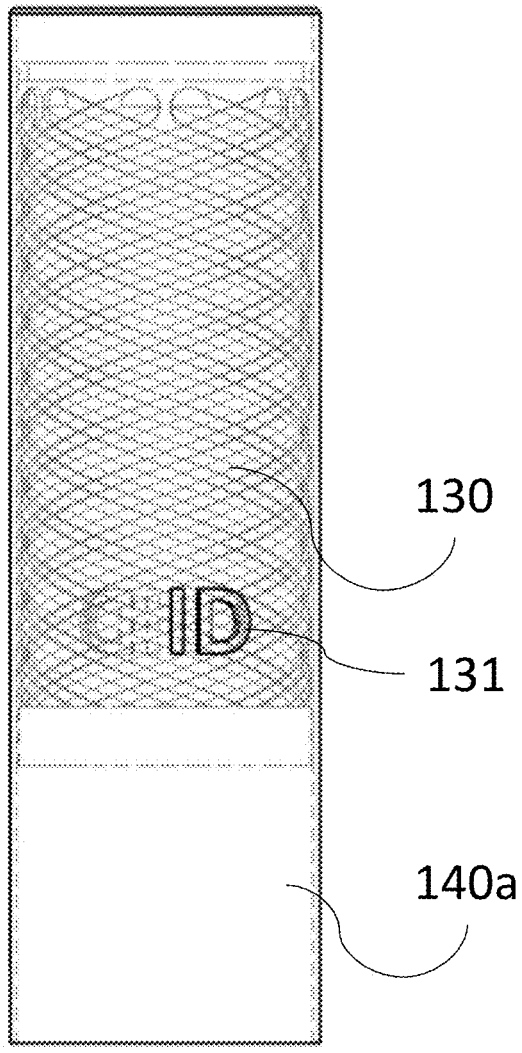
FIG. 16 is an elevation view showing the shell of FIG. 15, fastened onto the cylindrical spiral sleeve.

Referring to FIGS. 15-17, according to another embodiment of the invention, the shell 140*a* is configured to have a penetrating opening 142 through its side wall, compared with the concaved portion 141 of the shell 140*c* of FIG. 17. After assembly of the shell 140*a* and the cylindrical spiral sleeve 130, the embossed logo 'ID' 131 is directly visible.

The materials of the spiral sleeve 130 and the shell 140*a* may be different. Their material selections are determined according to the related needs. Generally, the spiral sleeve 130 may be made of plastic to ensure easier processing, while the shell 140*a* may be made of metal or resistant coated plastic to provide a better appearance.

The shell 140*a* can be made of aluminum, while the surface of the aluminum shell may have a nice appearance, its surface is also easy to apply decorative coatings, such as a branding logo or other branding designs. The shell 140*a* may be provided with a shiny or reflective coating or mirror finish, as desired. It will be appreciated that a thin shell 140*a* in combination with a thicker body 130 can provide a nice exterior finish, with good connection between 14*a* and 130 for rotation to cause the stick product to move, while reducing overall packaging materials and costs.

While the embossed logo 131 of the cylindrical spiral sleeve 130 is directly visible through the opening on the shell 140*a*, a decorative coating may be applied to the embossed logo 131, such as colorful paintings to improve the appearance of the logo 131.

As described above, the shell (140*a*, 140*b* or 140*c*) may be fastened onto the outer surface of the cylindrical spiral sleeve 130 with one pair of the attachment structures, such as projecting portions paired with concaved portions, to form a single body with a better branding appearance on the outer surface, which rotates as a whole.

Figure 25:
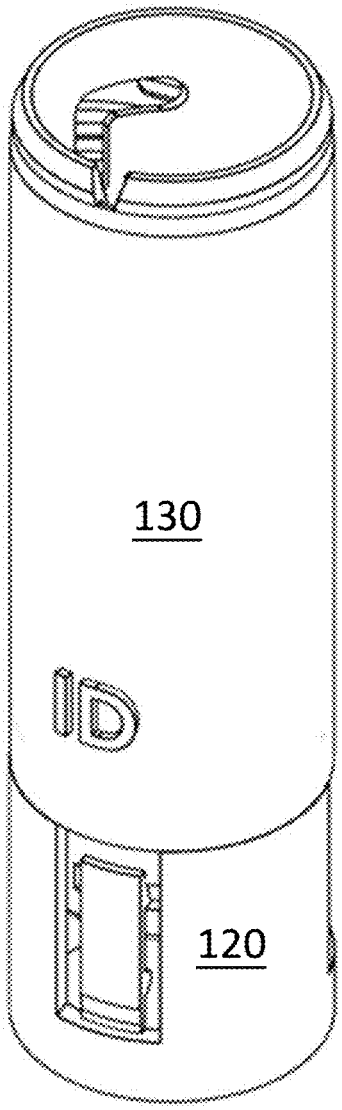
FIG. 25 is a perspective view of an assembled disposable cartridge, as a result of FIG. 22.
Figure 26:
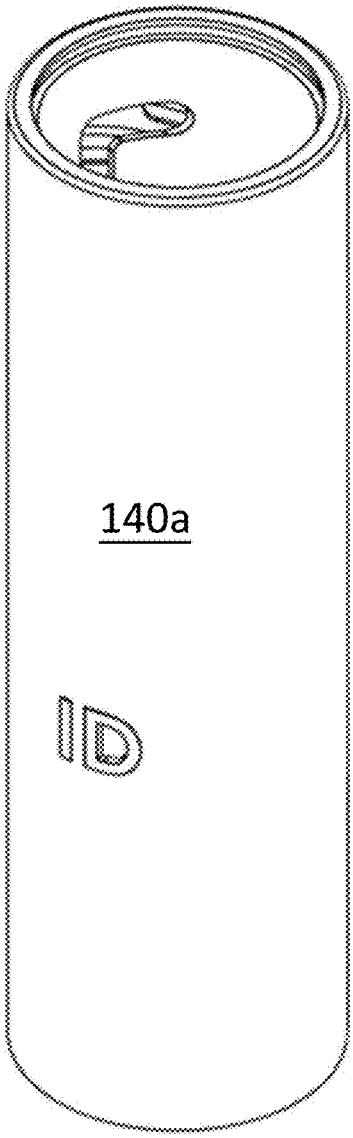
FIG. 26 is a perspective view of an assembled disposable cartridge, as a result of FIG. 24.

Referring to FIGS. 15-16 and 19-20, according to another embodiment of the invention, the shell 140*b* is configured to have a penetrating opening through its side wall, same as the shell 140*a*. Compared with the shell 140*a* of FIG. 15, the difference is that the shell being shorter on the lower portion, and the different lengths are shown in FIGS. 25 and 26.

Figure 9:
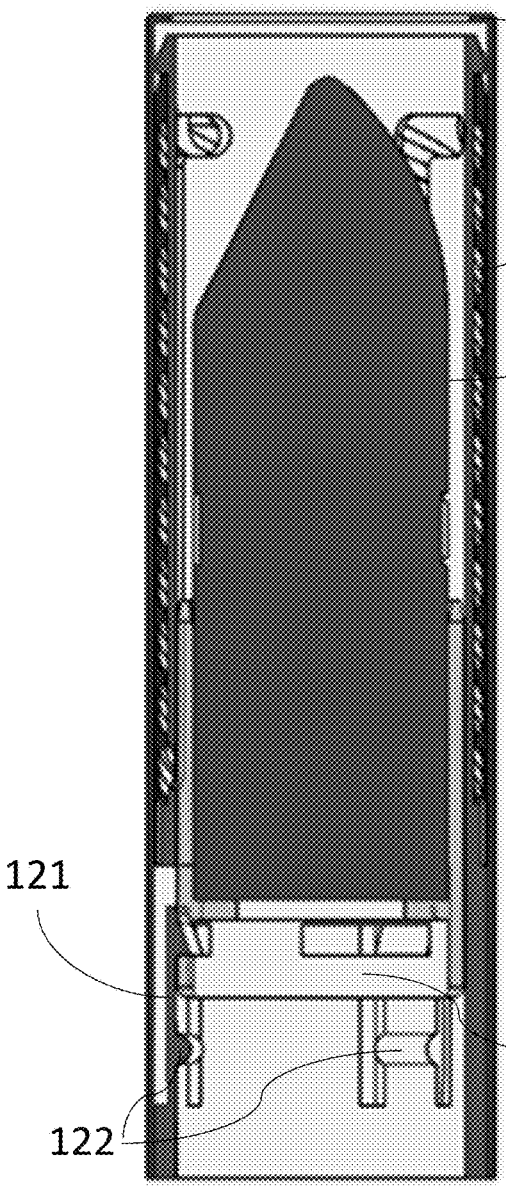
FIG. 9 is a side section view showing the disposable cartridge of FIG. 1, before installing on the rotating base.
Figure 10:
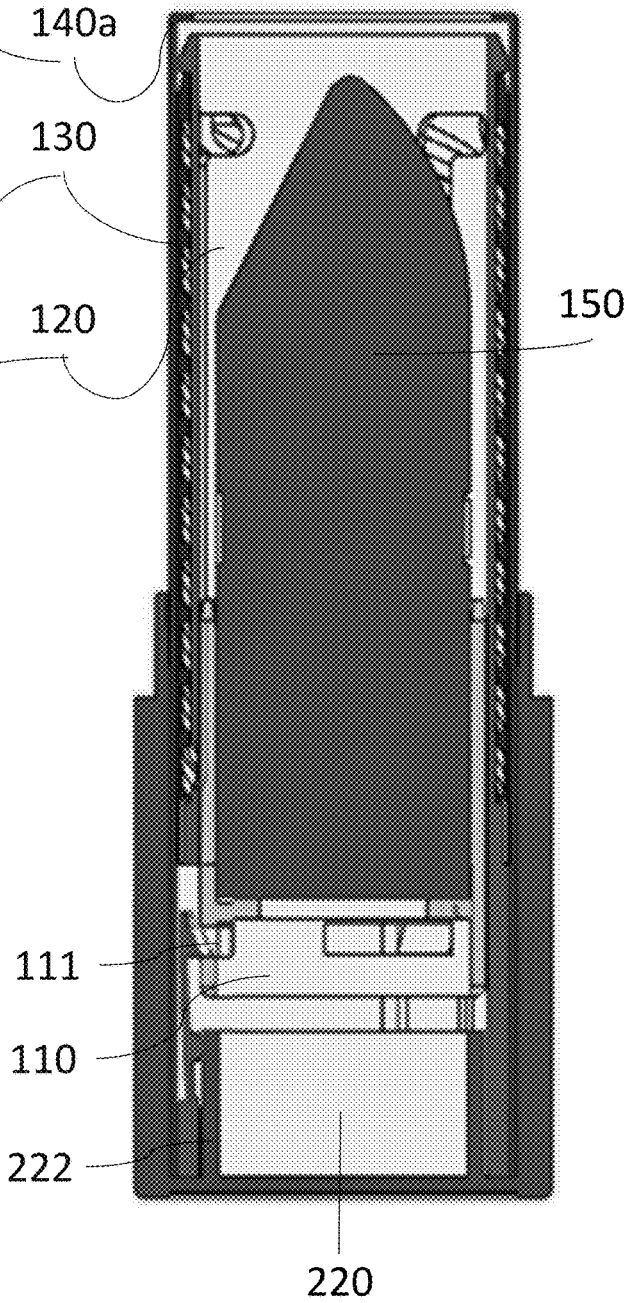
FIG. 10 is a side section view showing the disposable cartridge installed on the rotating base of FIG. 1.

Referring to FIGS. 9-10, according to the first embodiment of the invention, the disposable cartridge 100 of FIG. 1 has the shell 140*a* fastened onto the outer surface of the cylindrical spiral sleeve 130, FIGS. 9 and 10 show the cartridge 100 before and after being installed onto the rotating base 220, the steps are similar as described above for FIGS. 13-14.

Figure 11:
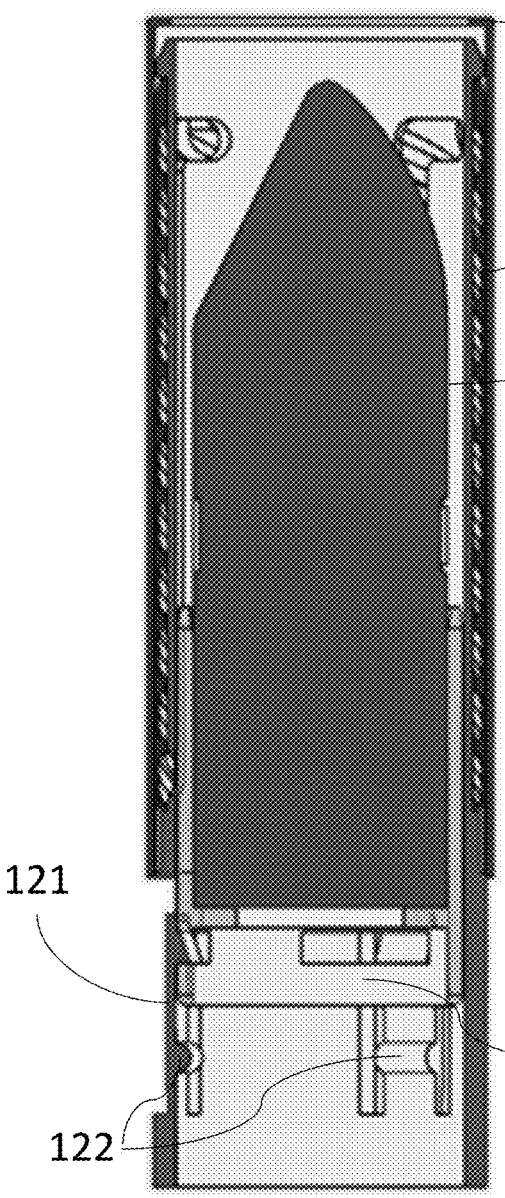
FIG. 11 is a side section view showing an alternate embodiment of the disposable cartridge, before installing on the rotating base.
Figure 12:
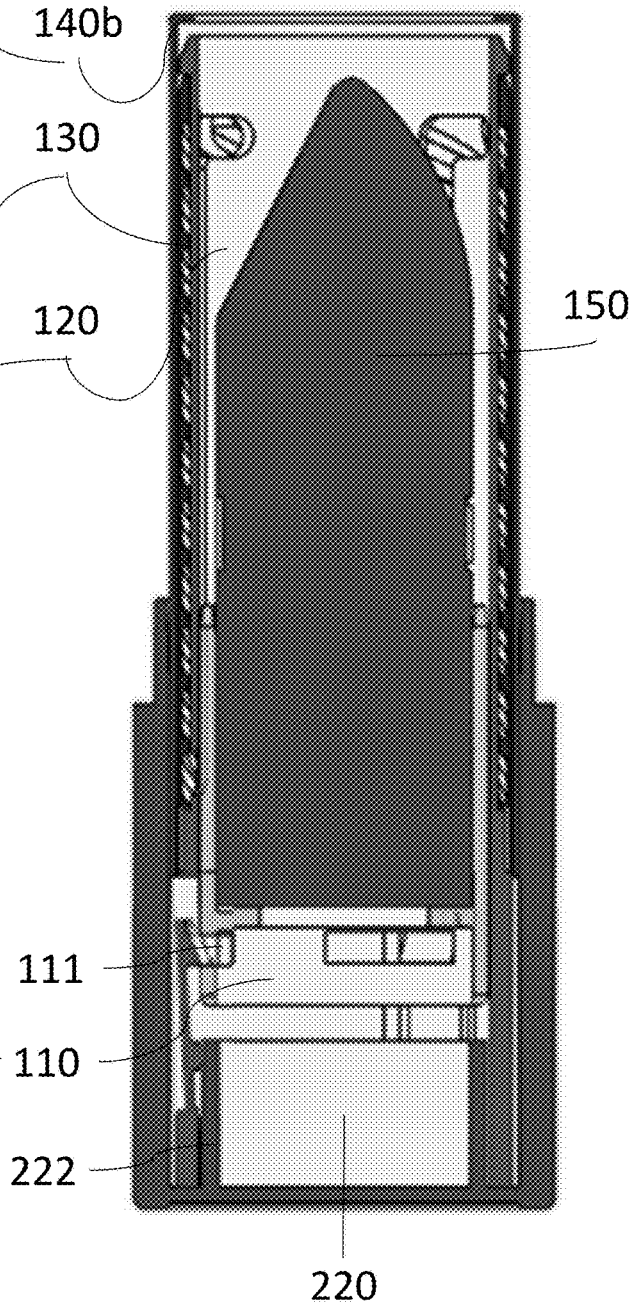
FIG. 12 is a side section view showing the disposable cartridge of FIG. 11, installed on the rotating base.

Referring to FIGS. 11-12, according to another embodiment of the invention, the disposable cartridge 100 has the shorter shell 140*b* fastened onto the outer surface of the cylindrical spiral sleeve 130, FIGS. 11 and 12 show the cartridge 100 before and after being installed onto the rotating base 220, the steps are similar as described above for FIGS. 13-14.

Figure 24:
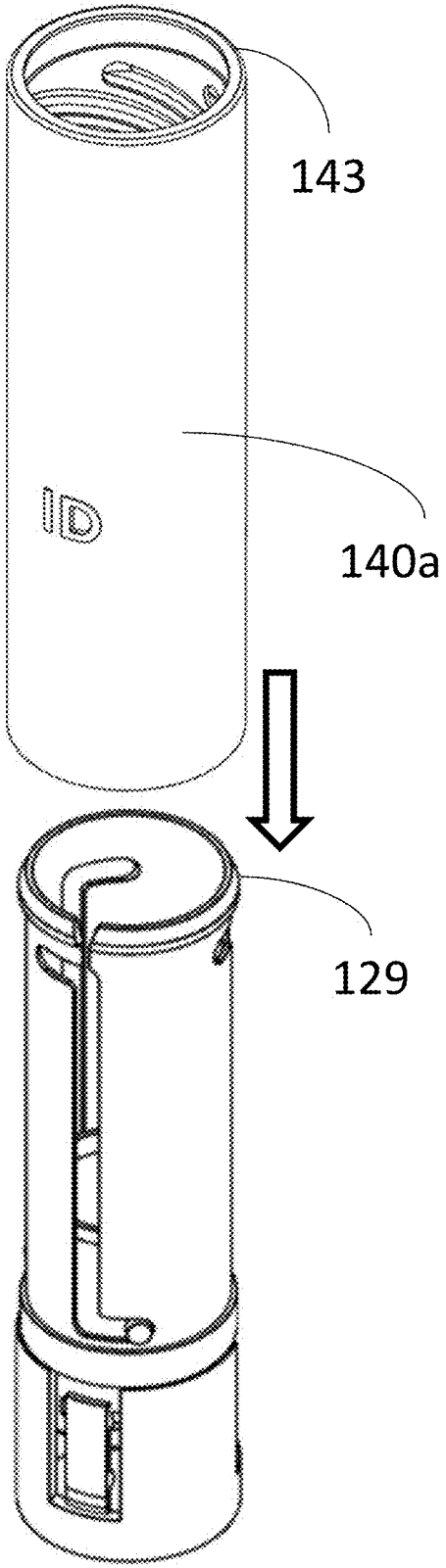
FIG. 24 is a perspective view of the inner body with a holding cup assembled of FIG. 23, being installed into a cylindrical spiral sleeve with its shell from the bottom opening of the cylindrical spiral sleeve.

Referring to FIG. 24, according to the first embodiment of the invention, the disposable cartridge 100 of FIG. 1 has the inner body 120 with the holding cup 110 assembled of FIG. 21, being installed into the cylindrical spiral sleeve 130 with its shell 140*a* from the bottom opening of the cylindrical spiral sleeve 130. The installing steps are similar as described above ones for FIG. 22, the only different result is: the rim 129 will be locked between the top opening of the spiral sleeve 130 and the top inner edge 143 of the shell 140*a*.

The stick product 150 may be inserted into the holding cup 110 of the cartridge 100 at the last step. For example, the cartridge 100 is assembled with the parts (110, 120, 130, 140*a*) at a first location, without the stick product 150; and the stick product 150 is inserted into the cartridge 100 at a second location, at a later time.

Referring to FIG. 26, according to the first embodiment of the invention, the disposable cartridge 100 of FIG. 1 has the inner body 120 with the holding cup 110 assembled of FIG. 21, being installed in the cylindrical spiral sleeve 130 with the shell 140*a*.

Figure 27:
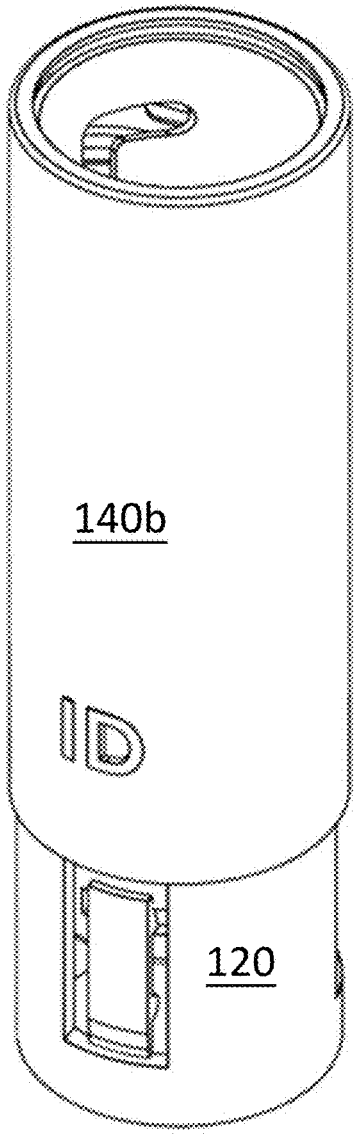
FIG. 27 is a perspective view of another embodiment of an assembled disposable cartridge, with the short shell.

Referring to FIG. 27, according to another embodiment of the invention, the disposable cartridge 100 of FIG. 1 has the inner body 120 with the holding cup 110 assembled of FIG. 21, being installed in the cylindrical spiral sleeve 130 with the shorter shell 140*b*.

Referring to FIG. 25, according to another embodiment of the invention, the disposable cartridge 100 of FIG. 1 has the inner body 120 with the holding cup 110 assembled of FIG. 21, being installed in the cylindrical spiral sleeve 130, without any shell (140*a* 140*b* or 140*c*).

The above designs of the locking features inside the cartridge, the six tracks on the sleeve, and the glue-free fastening provide advantages of lower damage rate of transport, better product performance and higher cost efficiency.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

Finally, those skilled in the art should appreciate that they can readily use the disclosed conception and specific embodiments as a basis for designing or modifying other structures for carrying out the same purposes of the present invention without departing from the spirit and scope of the invention as defined by the appended claims.

What is claimed is:

1. A disposable cartridge (100) of a stick product (10), for refilling in a reusable shell (200) comprising at least a reusable rotating base (220), the disposable cartridge (100) comprises:

a holding cup (110), being configured for receiving and retaining the stick product (10), the holding cup having at least one lug (112) located on the outer surface of the holding cup and an aperture (111) on its outer surface;

a cylindrical inner body (120), having top and bottom openings, and a cylindrical side wall with at least one longitudinal slot (125), the inner body having at least one flexible tab (121) located on its lower portion; and a cylindrical spiral sleeve (130), having top and bottom openings, and a cylindrical side wall with at least one spiral track (135) located on the interior surface;

the holding cup (110), the inner body (120), and the spiral sleeve (130) being assembled in order from inside to outside in a coaxial manner;

the at least one lug (112) being slidable in the at least one longitudinal slot (125) and in the spiral track (135), so that the inner body is configured to be rotated and drive the lug to slide along the spiral track, so as to drive the holding cup (110) to move in the axial direction;

wherein a tip portion (123) of the flexible tab (121) extending inward and inserted into the aperture (111) of the holding cup (110), so as to lock the holding cup with the inner body in a locked position;

when the disposable cartridge (100) being installed into the reusable rotating base (220), an unlocking portion (122) of the flexible tab is configured to contact an unlock structure (222) on the reusable rotating base (220), enabling the tip portion of the flexible tab to move outward and release the holding cup from its locked position.

2. The disposable cartridge of claim 1 wherein there are three lugs 120 degrees apart on the outer surface of the holding cup (110).

3. The disposable cartridge of claim 2 wherein there are three slots (125) 120 degrees apart on the wall of the inner body (120).

4. The disposable cartridge of claim 1 wherein there are two or more lugs evenly spaced on the outer surface of the holding cup (110).

5. The disposable cartridge of claim 1 wherein there are a plurality of spiral tracks (135) evenly spaced on the inner surface of the spiral sleeve (130), the number of the spiral tracks (135) is an integer multiple of the number of the lug (112).

6. The disposable cartridge of claim 1 wherein the aperture (111) is a circular groove on the outer surface of the holding cup (110).

7. The disposable cartridge of claim 1 wherein the at least one aperture (111) includes two or three penetrating slots evenly spaced on the wall of the holding cup (110).

8. The disposable cartridge of claim 1, wherein the cylindrical spiral sleeve is formed with an inner layer (130) and an outer layer (140*a*);

at least one embossed portion being formed on the outer surface of the inner layer;

at least one concaved portion at the respective position for the embossed portion being formed on the inner surface of the outer layer (140*a*), and the diameter of the embossed portion is slightly bigger than the diameter of the inner surface of the outer layer, so as to fasten the two layers.

9. A stick product, comprising a stick balm, a reusable shell (200), and the disposable cartridge (100) of claim 1, the stick balm being held in the holding cup (110) of the disposable cartridge (100);

the disposable cartridge (100) being installed onto a reusable rotating base of the reusable shell (200) so as to release the holding cup (110) of the disposable cartridge (100) from its locked position.

10. A method of manufacturing a stick product, comprising:

selecting a holding cup (110) with two or three lugs evenly spaced on its circular outer surface;

selecting a cylindrical inner body (120) with corresponding two or three longitudinal slots evenly spaced on its side wall;

sliding each of the two or three lugs of the holding cup into a respective longitudinal slot of the cylindrical inner body from its top opening;

providing a cylindrical spiral sleeve (130) having six (6) spiral tracks evenly spaced on its inner surface;

sliding the assembled holding cup and inner body together into the cylindrical spiral sleeve from its bottom opening while each of the two or three lugs on the holding cup fitting into a respective track of the six spiral tracks;

wherein the six spiral tracks enabling the spiral sleeve being adaptively suitable for receiving both 180-degree apart two-lug cup and 120-degree apart three-lug cup.

11. The method of claim 10, wherein the inner body (120) having a flexible tab (121) located on its lower portion; and the holding cup (110) having an aperture (111) on its outer surface;

when the holding cup (110) sliding down in the inner body (120), a tip portion (123) of the flexible tab (121) extending inward and inserted into the aperture (111), so as to lock the holding cup with the inner body in a locked position.

12. The method of claim 10, wherein the cylindrical spiral sleeve (130) has at least one embossed portion being formed on its outer surface.

13. The method of claim 12, further comprising: inserting the cylindrical spiral sleeve (130) into a cylindrical shell (140*a*);

the cylindrical shell (140*a*) having at least one concaved portion on its inner surface, at the respective position for the embossed portion of the cylindrical body;

wherein the cylindrical spiral sleeve (130) into the cylindrical shell (140*a*) by aligning the at least one concaved portion with the at least one embossed portion, and the diameter of the embossed portion is slightly bigger than the diameter of the inner surface of the shell, so as to fasten the cylindrical spiral sleeve (130) and the cylindrical shell (140*a*).

14. A stick product, comprising:

a cylindrical body (130), having one of an embossed portion and a concaved portion on the outer surface; and a cylindrical shell (140*a*), having another one of an embossed portion and a concaved portion on the inner surface, at the respective position for the one of an embossed portion and a concaved portion of the cylindrical body, wherein the cylindrical body is inserted into the cylindrical shell by aligning the concaved portion with the embossed portion to form an interference fit, so as to fasten the cylindrical body (130) and the shell (140*a*).

15. The stick product of claim 14, the cylindrical body comprising a holding cup (110), an inner body (120), and a spiral sleeve (130), being assembled in order from inside to outside in a coaxial manner; the holding cup (110) supporting a stick balm.

16. The stick product of claim 14, wherein the embossed portion is on the cylindrical body, and the concaved portion is on the shell and penetrating the wall of the shell, forming an opening enables viewing of the embossed portion of the cylindrical body.

17. The stick product of claim 14, wherein two embossed portions and two concaved portions being evenly spaced on the circular surfaces of one and the other of the cylindrical body and the cylindrical shell.

18. The stick product of claim 14, wherein the materials of the cylindrical body and the cylindrical shell are different.

* * * * *